US008061483B2

(12) United States Patent
Moriarty

(10) Patent No.: US 8,061,483 B2
(45) Date of Patent: Nov. 22, 2011

(54) WINDAGE BRAKING

(75) Inventor: Nicholas Moriarty, Blandford (GB)

(73) Assignee: Drop Zone UK Limited, Blandford, Dorset (GB)

( * ) Notice: Subject to any disclaimer, the term of this patent is extended or adjusted under 35 U.S.C. 154(b) by 917 days.

(21) Appl. No.: 11/725,545

(22) Filed: Mar. 20, 2007

(65) Prior Publication Data

US 2007/0240940 A1 Oct. 18, 2007

(30) Foreign Application Priority Data

Mar. 20, 2006 (GB) ..... 0605563.6

(51) Int. Cl.
*A62B 1/08* (2006.01)

(52) U.S. Cl. ..... 182/231; 182/70; 182/237; 188/270; 254/4 R; 254/47

(58) Field of Classification Search ..... 182/70, 182/71, 73, 75, 236, 237, 231, 232; 188/270
See application file for complete search history.

(56) References Cited

U.S. PATENT DOCUMENTS

| | | | | |
|---|---|---|---|---|
| 197,899 | A | 12/1877 | Root | |
| 295,047 | A * | 3/1884 | Parrott | 182/236 |
| 3,789,511 | A * | 2/1974 | Groom et al. | 33/312 |
| 4,029,298 | A * | 6/1977 | Lassche | 182/237 |
| 4,088,201 | A | 5/1978 | MacFarlane | |
| 4,442,918 | A | 4/1984 | Rhoads, Sr. | |
| 4,469,196 | A | 9/1984 | Sadler | |
| 5,259,433 | A * | 11/1993 | Cloutier | 160/190 |
| 5,348,116 | A * | 9/1994 | Pickering | 182/5 |
| 6,793,038 | B2 * | 9/2004 | Meller | 182/73 |
| 2006/0000675 | A1 * | 1/2006 | Penn et al. | 182/142 |
| 2006/0118060 | A1 * | 6/2006 | Ingraham et al. | 119/713 |

FOREIGN PATENT DOCUMENTS

| | | | |
|---|---|---|---|
| GB | 1 516 728 | | 7/1978 |
| GB | 2 319 232 | A | 5/1998 |
| WO | 03/033074 | A1 | 4/2003 |
| WO | WO 03/033074 | A1 | 4/2003 |
| WO | WO 2004/075991 | A2 | 10/2004 |

OTHER PUBLICATIONS

Definition of axis provided in action The American Heritage® Dictionary of the English Language, Fourth Edition copyright ©2000 by Houghton Mifflin Company. Updated in 2009. Published by Houghton Mifflin Company. All rights reserved.*

(Continued)

*Primary Examiner* — Katherine Mitchell
*Assistant Examiner* — Daniel Cahn
(74) *Attorney, Agent, or Firm* — Nixon & Vanderhye PC

(57) ABSTRACT

A windage brake for a fan descender comprises a rotatable spool connected by drive belts to a fan comprising a radial flow air impeller. A line is wound helically upon the spool. A user of the fan descender puts on a harness (not shown) at the free end of the line and jumps from an elevated position. The line is thereby drawn off the spool and rotates it. The rotating spool drives the fan and also winds a power spring formed by a resilient strip. The windage of the fan regulates the descent of the jumper, the fan being accelerated to a speed at which the braking force is such that the jumper descends at a rate safe for landing on the ground. When the jumper is on the ground, he removes the harness and releases the free end of the line. The line is then automatically retrieved by the power spring and rewound on the spool.

17 Claims, 2 Drawing Sheets

OTHER PUBLICATIONS

Definition of coaxial provided in action The American Heritage® Dictionary of the English Language, Fourth Edition copyright ©2000 by Houghton Mifflin Company. Updated in 2009. Published by Houghton Mifflin Company. All rights reserved.*

Definition of taper provided in action The American Heritage® Dictionary of the English Language, Fourth Edition copyright ©2000 by Houghton Mifflin Company. Updated in 2009. Published by Houghton Mifflin Company. All rights reserved.*

GB Search Report dated Mar. 12, 2007 and issued in corresponding GB Application No. 0605563.6.

International Search Report for PCT/GB2007/00989.

* cited by examiner

WINDAGE BRAKING

CROSS REFERENCE TO RELATED APPLICATIONS

This application claims priority from United Kingdom Patent Application No. 06 05 563.6, filed 20 Mar. 2006, the entire disclosure of which is incorporated herein by reference in its entirety.

TECHNICAL FIELD

This invention concerns a windage brake, which is to say apparatus employing air drag upon a rotating device to limit the speed of a moving item. The invention is particularly but not necessarily exclusively applicable to fan descenders and the like.

BACKGROUND OF THE INVENTION

A fan descender provides an exhilarating experience for adventure-minded individuals. It comprises an elevated platform (which may form part of or be set upon a tower, a bridge, a crane cradle, a building or a tree etc) from which a user jumps, his fall being controlled by a windage brake in the form of a fan rotated by a line connected to the jumper by means of a harness. If the line rotates the fan at a constant speed, the air drag on the fan is similarly constant, and the jumper descends at a steady rate. For greater exhilaration, however, the fan descender is designed so that the line initially rotates the fan relatively slowly, with low drag, and the fan does not accelerate to provide full drag until the jumper nears the ground. This is achieved by having the line wound helically upon a spool connected to the fan, the spool tapering along the length of the helix so as to be accelerated as the line unwinds. By this means the jumper experiences something that feels like freefall immediately after jumping but is slowed to a safe rate of descent before landing.

A disadvantage of previous windage brakes for fan descenders is that they have commonly used a counterweight arrangement to retrieve the line after each jump: that is, a weight is lifted as the jumper descends, and after the jump is completed this weight and the jumper releases the harness, the weight itself descends again and retrieves the line. This restricts locations where the fan descender can be installed, requires an involved installation procedure and has a somewhat unprofessional appearance.

BRIEF SUMMARY OF THE INVENTION

According to an aspect of the present invention, there is provided a windage brake comprising a spool mounted for rotation about a first axis, a line wound helically upon the spool and having a free end extending therefrom, a fan driven by the spool to rotate when the line is drawn off from the spool by its free end, thereby to limit the speed of rotation of the spool and hence the rate at which the line is drawn off, and a retrieval mechanism operative to rewind the line upon the spool when the free end of the line is released, wherein the spool tapers along said first axis.

The retrieval mechanism may comprise a retractor spring (possibly more than one) which is resiliently loaded when the spool is rotated by drawing off the line and resiles to rewind the line upon the spool when the free end of the line (24) is released. The retractor spring may be a power spring (also known as a clock spring) and comprise a resilient strip wound spirally about an arbor, which may be coaxial with the fan.

The resilient strip may extend from the arbor to a hub whereupon it is wound spirally as the line is drawn off the spool, and preferably the spiral winding of the resilient strip upon the hub is in a direction opposite to that of its winding on the arbor.

Preferably the spool is formed with a helical channel for the line so that the line is guided as it is drawn off the spool and as it is rewound thereupon.

Heretofore windage brakes have conventionally had the fan secured to the spool, to rotate directly with it, and this has three disadvantages. First, the speed of rotation of the fan is identically that of the spool, so to get the fan to the high speed necessary to slow the jumper's descent before landing requires the line to unwind very quickly, which may be difficult to control. Second, there is no way of adjusting the speed of the fan relative to that of the spool. Third, having the fan secured to the spool results in an assembly with a long axial dimension and hence generally bulky and requiring a permanent mounting.

It is a further object of the invention to provide a more compact windage brake that may be transportable and have a fan that can rotate at a different (typically, higher) speed than the spool.

To this end a windage brake according to the invention may have its fan rotatable about a second axis and include a drive mechanism between the spool and the fan to cause the fan to rotate when the free end of the line is drawn off from the spool.

Preferably the spool has a taper along the first axis from a relatively large diameter part to a relatively small diameter part and the free end of the line extends initially from the large diameter part of the spool and in use the line is drawn off down the taper. The spool may have a generally cylindrical portion extending axially from the small diameter part so that, after the fan has been accelerated by the effect of the taper, it then runs at substantially constant speed thereby to provide a substantially constant braking force and thereby a steady rate of descent.

The second axis is preferably parallel to the first axis.

The drive mechanism may comprise one or more drive belts, and at least one of such drive belts preferably interconnects a first drive pulley connected to the spool and a second drive pulley connected to the fan, the first drive pulley being of greater working diameter than the second drive pulley. In the operation of this arrangement, the fan rotates faster than the spool and thereby an appropriate braking force can be obtained from a relatively small fan. One of the drive pulleys may be replaceable by another drive pulley of different working diameter, so that the braking force can be conveniently adjusted. Preferably the or each drive belt is toothed.

The fan preferably comprises a radial flow air impeller. This impeller may have a plurality of vanes spaced around a generally cylindrical periphery circumscribing the axis of the fan. Preferably each vane curves forward (in the direction of rotation of the fan) from a root thereof to a tip thereof, and each vane may have a leading edge at its tip which is substantially tangential of the periphery and a trailing edge at its root which is substantially radial thereof. Preferably also the fan is so configured and arranged that the air exits therefrom at a speed greater than the tip speed of the fan.

If the windage brake is compact it can be transported and installed at any desired location as a complete assembly, saving time and cost and helping to ensure that the brake is safe by permitting pre-installation testing. A compact brake requires a compact spool, and this in turn necessitates a line which can be bent repeatedly to a small radius as well as being strong and robust. To this end the line preferably comprises a braid of gel-spun polyethylene filaments with high strength, high modulus and low creep.

The benefit of compactness is reduced if the brake needs to be assembled at the elevated installation location. Therefore the windage brake is preferably incorporated in regulating apparatus for regulating the descent of a person from an elevated position, the brake being carried in a frame for securing the apparatus assembled at the elevated position. For quick and convenient installation the regulating apparatus may include karabiners for securing the apparatus assembled at the elevated position. Preferably a harness is provided at the free end of the line for attaching the line to said person.

The invention extends to a facility for recreational, educational, training or rescue purposes such as a fan descender or a zip wire including an elevated platform from which a person descends and regulating apparatus according to the invention.

BRIEF DESCRIPTION OF THE SEVERAL VIEWS OF THE DRAWINGS

Other features of the invention will be apparent from the following description, which is made by way of example only with reference to the accompanying schematic drawing in which—

The figures use common reference numbers.

DESCRIPTION OF THE BEST MODE FOR CARRYING OUT THE INVENTION

Figure 1:
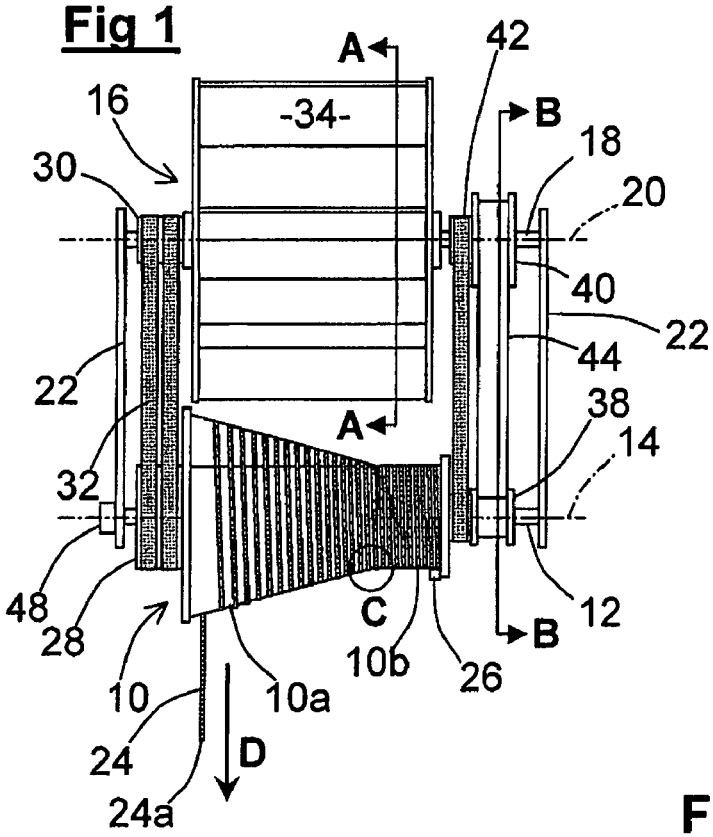
FIG. 1 is a diagrammatic front elevation of a windage brake according to the invention comprising a spool and a fan.
Figure 2:
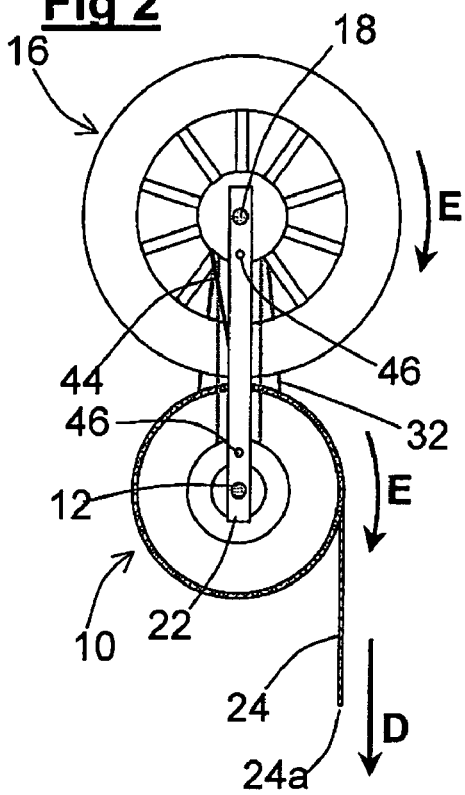
FIG. 2 is a diagrammatic side elevation corresponding to FIG. 1.

Referring first to FIGS. 1 and 2, the windage brake shown therein comprises a spool 10 mounted on a spindle 12 to be rotatable about a first axis 14 and a fan 16 mounted on a spindle 18 to be rotatable about a second axis 20 parallel to the first axis 14. The spindles 12 and 18 extend between a pair of end plates 22 thereby forming a frame to carry the windage brake. A line 24 having a free end 24*a* is wound helically upon the spool 10, its other end being secured to the spool 10 by a clamp 26. The line 24 is a braid of gel-spun polyethylene filaments with high strength, high modulus and low creep available under the registered trade mark Dyneema from DSM of The Netherlands.

Secured to one end (the left hand end as seen in FIG. 1) of the spool 10 and rotatable about the spindle 12 is a first drive pulley 28. Secured to the left hand end of the fan 16 and rotatable therewith about the spindle 18 is a second drive pulley 30. A pair of drive belts 32 interconnect the pulleys 28 and 30 so that the fan 16 rotates when the spool 10 rotates. Although not so illustrated, the drive belts 32 are toothed belts and the pulleys 28 and 30 appropriately formed therefor. And also not shown, for simplicity of illustration, an idler wheel bears on each drive belt 32 and is movable arcuately to adjust the tension thereof.

When the free end 24*a* of the line is pulled, the line 24 is progressively drawn off the spool 10, causing it to rotate about the spindle 12 in the direction of arrow D. The drive belts 32 then drive the fan 16 rotatably about the spindle 18 in the direction of arrow E, ie in the same direction of rotation as the spool 10 (which for convenience may be regarded as the forward direction)

Figure 3:
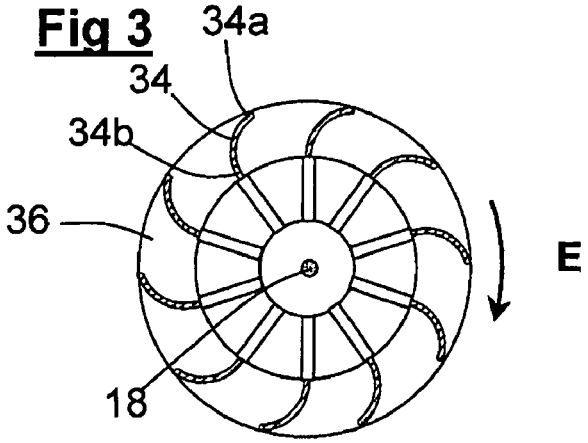
FIG. 3 is a diagrammatic cross-section at A-A of FIG. 1 illustrating the fan of the windage brake.
Figure 4:
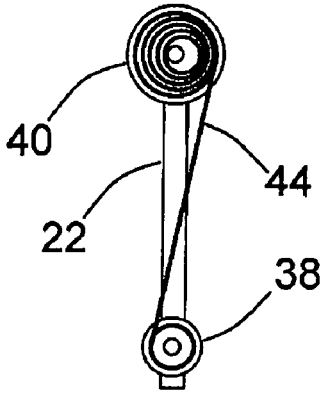
FIG. 4 is a diagrammatic cross-section at B-B of FIG. 1, illustrating a spring-powered retrieval mechanism of the windage brake.

The fan 16 has a generally cylindrical periphery about the axis 20 with a plurality of vanes spaced around this periphery, a representative vane of such plurality being identified in the drawing by reference numeral 34. As can be seen in FIG. 3, the vane 34 (and each of the vanes) has at its tip a leading edge 34*a* which is generally tangential of the cylindrical periphery 36 and at its root a trailing edge 36 which is generally radial and is curved forwards (in the direction of rotation of the fan as indicated by arrow E). Thus, as the fan 16 is driven to rotate in the direction of arrow E, it acts as a radial flow air impeller. Those skilled in the science will appreciate that the design of this impeller is such as to give rise to considerable windage. In fact, the forward curvature of the vanes is such that the exit speed of air from the fan 16 is considerably greater than the tip speed of the fan 16. The essential function of the fan 16 in the present invention is that the windage caused by rotation of the fan 16 (in the forward direction) acts as a retarding force on the (forward) rotation of the spool 10. Thus the line 24 is braked. The use of forwardly curved vanes delivers a retarding force which may be twice as much as a fan with simple radial vanes.

The windage and hence the braking force on the line 24 depends upon the speed of rotation of the fan 16, and in the present invention this is adjusted in several ways. First, the spool 10 has a taper 10*a* extending (towards the right as seen in FIG. 1) from a relatively large diameter part to a relatively small diameter part. Thus, as the line 24 is drawn off from the spool 10, it acts on a progressively smaller diameter as it unwinds along the taper 10*a*, thereby accelerating the spool 10. Initially the rotation of the spool 10 is relatively slow, and therefore the rotation of the fan 16 is similarly slow and its windage braking force low. As the spool 10 accelerates, the fan 16 similarly accelerates, and the windage braking force increases. At the right hand end of the taper 10*a* the spool continues with a generally cylindrical portion 10*b*, where drawing off the line 24 at a constant rate rotates the spool 10 at a constant speed, so that the fan 16 also rotates at a constant speed and generates a constant windage braking force.

The use of Dyneema line facilitates a steep angle on the taper 10*a* and a small final diameter, both of which contribute to a compact arrangement. Dyneema line is also strong and has good wear resistance, contributing to safety.

The drive pulley 28 secured to the spool 10 has a working diameter larger than that of the drive pulley 30 secured to the fan 16. This provides another adjustment to the speed of the fan 16, which will be understood to rotate faster than the spool 10. Insofar as windage of the fan 16 depends upon its speed of rotation, it follows that this arrangement allows a smaller fan 16 to be used for a given windage braking force. It is also to be understood that either or both of the pulleys 28 and 30 may be replaced by pulleys of different working diameters, allowing the rotational speeds and braking force to be varied.

At its right hand end as seen in FIG. 1 the spool 10 has a hub 38 rotatable with the spool 10. At the right hand end, of the fan 16 but free therefrom is an arbor 40. A retrieve drive belt 42 extends between two pulleys respectively secured to the hub 38 and the arbor 40. A resilent strip of spring steel 44 is loosely coiled spirally in one direction around the arbor 40 and extends therefrom to the hub 38. As the line 24 is drawn off the spool 16, rotating it in its forward direction, the resilient strip 42 is tightly coiled spirally around the hub 38 in the opposite direction from the spiral winding on the arbor 40. Thus the resilient strip 42 provides a power spring which is wound as the line 24 is drawn off from the spool 10. If the line 24 is released, this power spring resiles to its unwound state, rotating the arbor 40 backwards. This backward rotation of the arbor 40 is transmitted to the hub 16 by way of the retrieve drive belt 42, and hence the spool 10 is reversed to draw the line 24 back onto the spool 10.

Figure 5:
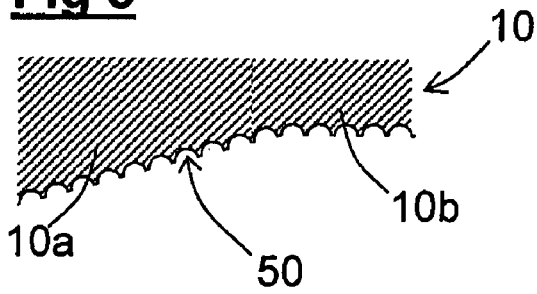
FIG. 5 is an enlarged cross-section as at C of FIG. 1, illustrating the form of the spool of the windage brake.

Although for simplicity of illustration not shown in FIG. 1, the spool 10 is formed with a helical channel 50 to guide the line 24, part of which channel 50 is shown diagrammatically in FIG. 5.

The operation of the invention as applied to a fan descender will now be described. The fan descender is not shown in the drawing, but it comprises a tower with an elevated platform and means enabling persons to climb to the platform from where they are to jump. The assembly heretofore described is secured at an elevated position on the tower, conveniently by means of karabiners (not shown) secured to a holdfast and engaged in holes 46 in the end plates 22 of the assembly. A harness not shown is secured to the free end 24*a* of the line 24 and the jumper puts on this harness. (It will be appreciated that various safety precautions are taken, but it is not considered necessary to detail them here).

When ready, the jumper jumps off the platform, causing the line 24 to be drawn off the spool 10, rotating the spool 10 and the fan 16. Initially, the line 24 being drawn off from the large diameter part of the spool 10, the windage braking force is low, and the jumper descends at a speed approaching free fall. As the line 24 unwinds down the taper 10*a*, the effective diameter of the spool 10*a* decreases, the fan 16 accelerates and the windage braking force increases. Thus the descent of the jumper is progressively slowed. After the line 24 reaches the bottom of the taper 10*a*, the jumper descends at a steady terminal rate as the line unwinds along the cylindrical portion 10*b* of the spool 10.

The terminal rate of descent is determined (with, at least, empirical checks) to be slow enough for the jumper to land on the ground safely—at a vertical speed of not more than 3 m/s for a person weighing 150 kg. Similarly, the line 24 is long enough to allow the jumper to reach the ground.

When the jumper is safely on the ground, he removes the harness. When this is released, there is no longer any substantial load on the line 24, and the power spring provided by the resilient strip 44 retrieves the line automatically and causes it to be wound back onto the spool 24. It will be understood that this retrieval mechanism of the invention is considerably tidier and more convenient than rewinding by counterweight as was common heretofore.

Each jump activates an electronic counter illustrated diagrammatically at 48 in FIG. 1, whereby the number of jumps is recorded. Thus the operator of a fan descender embodying the invention can pay for it in relation to its utilisation and maintenance can also be related to the amount of use.

Figure 6:
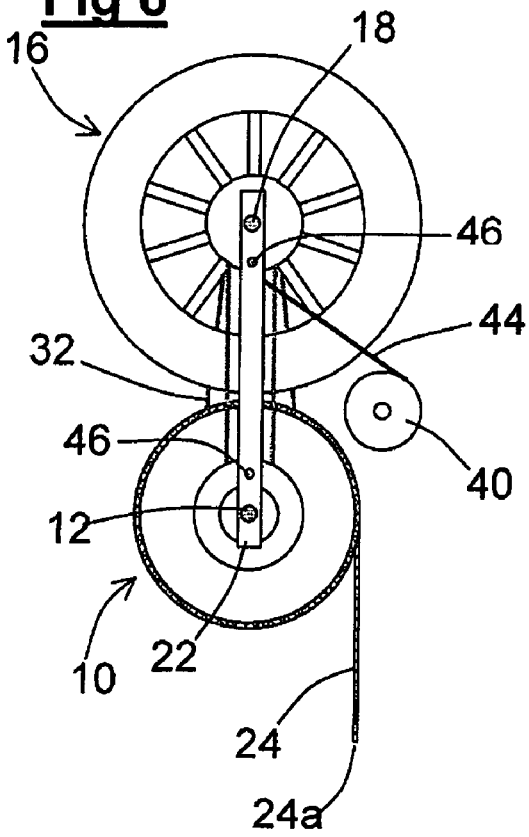
FIG. 6 illustrates a modified windage brake according to the invention.

FIG. 6 illustrates a modified form of the invention in which the arbor 40 is offset from the spindle 18 of the fan 16. Among other things this allows the spool 10 to be lengthened, and thereby carry more cable 24 for a greater drop, without increasing the overall length of the machine.

Various other modifications may be made. A plurality of retractor springs 44 may be provided, to increase the strength and speed of retrieval of the cable 24. Also, especially for large drops, the spool 10 may be formed with another cylindrical section to the left of the tapered section 10*a* as viewed in FIG. 1, and two or more fans 16 may be provided. The retrieval mechanism may comprise an electric motor.

Those skilled in the science will appreciate that the invention may be applied to a zip wire or other facilities for recreational, educational, training or safety purposes. Further, whilst the invention has been particularly described as being used by a person who jumps from an elevated platform, is also to be understood that the invention may be adapted to provide safety apparatus for a climber, who can be clipped into the described harness on the ground and then make an ascent (of a tower or climbing wall, say) knowing that he will be lowered safely to the ground if he should fall. Finally, the invention has been described and illustrated with belts for driving the fan and retrieving the line, but some other mechanism such as gears or chains may otherwise be used.

What we claim is:

1. A fan descender comprising:

a tapered spool having a varying diameter and mounted for rotation about a first axis, a line wound helically upon the spool and having a free end extending therefrom and a secured end attached to the spool, a windage braking fan rotatably driven by the spool so that when the spool rotates as the line is drawn off from the spool by said free end, the windage braking fan provides braking which limits rotational speed of the spool which limits a rate at which the line is drawn off, and a retrieval mechanism operative to rewind the line upon the spool when the free end of the line is released, wherein the spool tapers along said first axis from a relatively larger diameter part of said spool to a relatively smaller diameter part of said spool, the secured end of the line is attached to the relatively smaller diameter part and the line is wound on the tapered spool towards the larger diameter part whereby, in use, as the line is drawn off, it unwinds along the spool towards the smaller diameter portion and thus accelerates the spool which accelerates the fan which increases the braking.

2. A fan descender as claimed in claim 1 wherein the retrieval mechanism comprises a retractor spring which is resiliently loaded when the spool is rotated by drawing off the line and then the retractor spring resiles to rewind the line upon the spool when the free end of the line is released.

3. A fan descender as claimed in claim 2 wherein the retractor spring is a power spring.

4. A fan descender as claimed in claim 3 wherein the retractor spring comprises a resilient strip wound spirally about an arbor, the arbor being coaxial with the fan.

5. A fan descender as claimed in claim 4 wherein the resilient strip extends from the arbor to a hub whereupon the resilient strip is wound spirally as the line is drawn off the spool in a direction opposite to a direction that the resilient spring winds when winding on the arbor.

6. A fan descender as claimed in claim 1 wherein the spool is formed with a helical channel for the line.

7. A fan descender as claimed in claim 1 wherein the fan is rotatable about a second axis parallel to the first axis and there is a drive mechanism between the spool and the fan to cause the fan to rotate when the free end of the line is drawn off from the spool.

8. A fan descender as claimed in claim 1 wherein the spool has a generally cylindrical portion extending axially from the small diameter part and a generally cylindrical portion extending axially from the large diameter part.

9. A fan descender as claimed in claim 1 wherein the fan comprises a radial flow air impeller.

10. A fan descender as claimed in claim 9 wherein the impeller comprises a plurality of vanes spaced around a generally cylindrical periphery circumscribing an axis of the fan.

11. A fan descender as claimed in claim 10 wherein each vane curves towards the direction of fan rotation from a root thereof to a tip thereof.

12. A fan descender as claimed in claim 11 wherein each vane has a leading tip edge which is substantially tangential of the periphery and a trailing root edge which is substantially radial thereof.

13. A fan descender as claimed in claim 11 wherein the fan is so configured and arranged that the air exits therefrom at a speed greater than a tip speed of the fan.

14. A fan descender as claimed in claim 7 wherein the drive mechanism comprises one or more drive belts.

15. A fan descender as claimed in claim 14 wherein at least one of the drive belts interconnects a first drive pulley connected to the spool and a second drive pulley connected to the fan, the first drive pulley being of greater working diameter than the second drive pulley.

16. A fan descender as claimed in claim 15 wherein at least one of said drive pulleys is replaceable by another drive pulley of different working diameter.

17. A facility for recreational, education, training or safety purposes including an elevated platform capable of receiving a person for a descent from the platform, wherein said recreational facility includes a fan descender as claimed in claim 1 for regulating the descent of that person.

* * * * *